US006146242A

United States Patent [19]

Treur et al.

[11] Patent Number: 6,146,242

[45] Date of Patent: Nov. 14, 2000

[54] OPTICAL VIEW PORT FOR CHEMICAL MECHANICAL PLANARIZATION ENDPOINT DETECTION

[75] Inventors: Randolph E. Treur; John M. Boyd; Stephan H. Wolf, all of San Luis Obispo, Calif.

[73] Assignee: Strasbaugh, Inc., San Luis Obispo, Calif.

[21] Appl. No.: 09/330,472

[22] Filed: Jun. 11, 1999

[51] Int. Cl.[7] ..... B24B 49/00

[52] U.S. Cl. ..... 451/6

[58] Field of Search ..... 451/6, 41, 288, 451/287, 5, 526, 533

[56] References Cited

U.S. PATENT DOCUMENTS

| | | | |
|---|---|---|---|
| 4,168,262 | 10/1986 | Maydan, et al. | 356/357 |
| 5,308,447 | 5/1994 | Lewis, et al. | 156/626 |
| 5,310,260 | 5/1994 | Schietinger, et al. | 374/142 |
| 5,427,878 | 6/1995 | Corliss | 430/30 |
| 5,433,651 | 7/1995 | Lustig et al. | 451/6 |
| 5,605,760 | 2/1997 | Roberts | 428/409 |
| 5,609,511 | 3/1997 | Moriyama et al. | 451/5 |
| 5,663,797 | 9/1997 | Sandhu | 438/16 |
| 5,700,180 | 12/1997 | Sandhu et al. | 451/5 |
| 5,838,447 | 11/1998 | Hiyama et al. | 451/6 |
| 5,893,796 | 4/1999 | Birang et al. | 451/287 |

FOREIGN PATENT DOCUMENTS

| | | | |
|---|---|---|---|
| 3234467 | 10/1991 | Japan | 451/6 |
| WO 95/18353 | 7/1995 | WIPO | G01B 11/06 |

*Primary Examiner*—Robert A. Rose
*Attorney, Agent, or Firm*—K. David Crockett, Esq.; Crockett & Crockett

[57] ABSTRACT

An optical endpoint system for a CMP system with a viewport located off-center on the platen, said view port being adjustable in height so that the window of the viewport can be made flush with the top of the polishing pad.

2 Claims, 6 Drawing Sheets

5
6
22
20
26
5
2
3
2
3
7
25
11
11
25
24
8
13
21

OPTICAL VIEW PORT FOR CHEMICAL MECHANICAL PLANARIZATION ENDPOINT DETECTION

FIELD OF THE INVENTIONS

The inventions described below relate to the processes of chemical mechanical polishing, and devices and methods for monitoring the progress of the polishing process.

BACKGROUND OF THE INVENTION

Construction of integrated circuits requires the creation of many layers of material on a substrate of a silicon wafer. The layers are created in numerous steps, creating or depositing material first on the wafer and then polishing the wafer until the layer is very flat, or planarized. Some layers are created by deposition or etching of a circuit, with an intended irregular topology. Some layers are created by allowing the underlying layer to oxidize or otherwise react with the atmosphere, without the possibility of control over the flatness of the resultant layer. Thus, many of the layers must be polished to flatten or "planarize" the surface until it is suitably flat for creation of the next layer. The process of layer deposition and planarization is repeated many times over to create a number of layers with electronic circuitry on many of the layers and interconnects between the layers to connect this circuitry. The end result can be an extremely complicated yet miniature device. The complexity of the circuits which can be created depends on several factors, one of which is the degree of flatness which can be created in the planarization process, and the reliability of the planarization. Planarization of the layers preferably results in surface variation over a large area (500–1000 square millimeters on the order of 1000 angstroms or less.

One method for achieving semiconductor wafer planarization or topography removal is the chemical mechanical polishing (CMP) process. Chemical mechanical polishing (CMP) is a process for very finely polishing surfaces under precisely controlled conditions. In applications such as polishing wafers and integrated circuits, the process is used to remove a few angstroms of material from an integrated circuit layer, removing a precise thickness from the surface and leaving a perfectly flat surface. To perform chemical mechanical polishing, a slurry comprising a suitable abrasive, a chemical agent which enhances the abrasion process, and water is pumped onto a set of polishing pads. The polishing pads are rotated over the surface requiring polishing (actually, in processing silicon wafers and integrated circuits, the polishing pads are rotated under the wafers, and the wafers are suspended over the polishing pads and rotated). The amount of polishing (the thickness removed and the flatness of the finished surface) is controlled by controlling the time spent polishing, the distribution of abrasives in the slurry, the amount of slurry pumped into the polishing pads, and the slurry composition (and other parameters). While it is therefore important to control each of these parameters in order to get a predictable and reliable result from the polishing process, it is also desired to provide a method for determine when the wafer surface has been planarized to the specified flatness. Determination of when the wafer has been polished to the specified flatness is referred to as "endpoint detection." In a crude method, the wafer can be removed from its polishing chamber and measured for flatness. Wafers that meet the desired flatness specification can be passed onto further processing steps; wafers that have not yet been polished enough to meet the desired flatness specification can be returned to the polishing chamber, and wafers that have been over polished can be discarded. More advanced methods measure the wafer surface during the polishing process within the chamber, and are generally referred to as "in-situ" endpoint detection. Devices and methods for measuring wafer flatness by interpreting various wafer properties, such as reflection of ultrasonic sound waves, changes in mechanical resistance of the wafer to polishing, electrical impedance of the wafer surface, or wafer surface temperature, have been employed to determine whether the wafer is flat.

Recently, a process referred to as optical endpoint detection has been developed to measure the thickness of the top layer of a wafer. Optical endpoint detection refers to the process of transmitting a laser beam onto the surface of the wafer and analyzing the reflection. Most of the laser beam is reflected by the upper surface of the top layer of the wafer, by some of the laser beam penetrates the top layer and is reflected by the underlying layer. The two reflected light beams are reflected to an interferometer, which measures the interference between the two light beams. The degree of interference is indicative of the thickness of the layer, permitting precise determination of the layer thickness at the point of measurement. Numerous measurements over the surface of the wafer can be compared to obtain an overall indication of surface flatness. The process has been described in reference to plasma etching in Corliss, Semiconductor Wafer Processing With Across-Wafer Critical Dimension Monitoring Using Optical Endpoint Detection, U.S. Pat. No. 5,427,878 (Jun. 27, 1995), and in reference to chemical mechanical polishing in Birang, et al., Forming A Transparent Window In A Polishing Pad For A Chemical Mechanical Polishing Apparatus, U.S. Pat. No. 5,893,796 (Apr. 13, 1999). Birang describes a method of performing endpoint monitoring by passing a laser beam through a hole in the polishing pad and supporting platen. This hole is positioned such that it has a view of the wafer held by a polishing head during a portion of the platen's rotation in which the hole passes over a stationary laser interferometer within the CMP process chamber. The hole in the pad is filled with a transparent plug which is glued into the polishing pad. In this system, condensation and slurry seepage into the space under the window can interfere with the laser beam transmission, and imperfect match between the level of the pad and the level of the transparent plug can cause trenching in the wafer.

SUMMARY

The devices described below enable optical endpoint detection in a chemical mechanical planarization system using a rotating polishing platen and off center wafer head tracks. The optical viewport through which the requisite optical fibers transmit and receive light from the wafer surface is located in the platen and polishing pad, off the center of the polishing platen, and communicates with the laser source and laser interferometry equipment through a fiber optic bundle which extends radially from the viewport position radially displaced from the center of the platen to the center of the platen, and downward through the platen spindle to a rotary optical coupling which permits the bundle to rotate with the platen during the polishing process.

The optical viewport is provided as an assembly including a transparent window, a window casing which can be adjusted in height relative the platen and polishing pad, to permit flush adjustment with a variety of pad of different thickness.

DETAILED DESCRIPTION OF THE INVENTIONS

Figure 1:
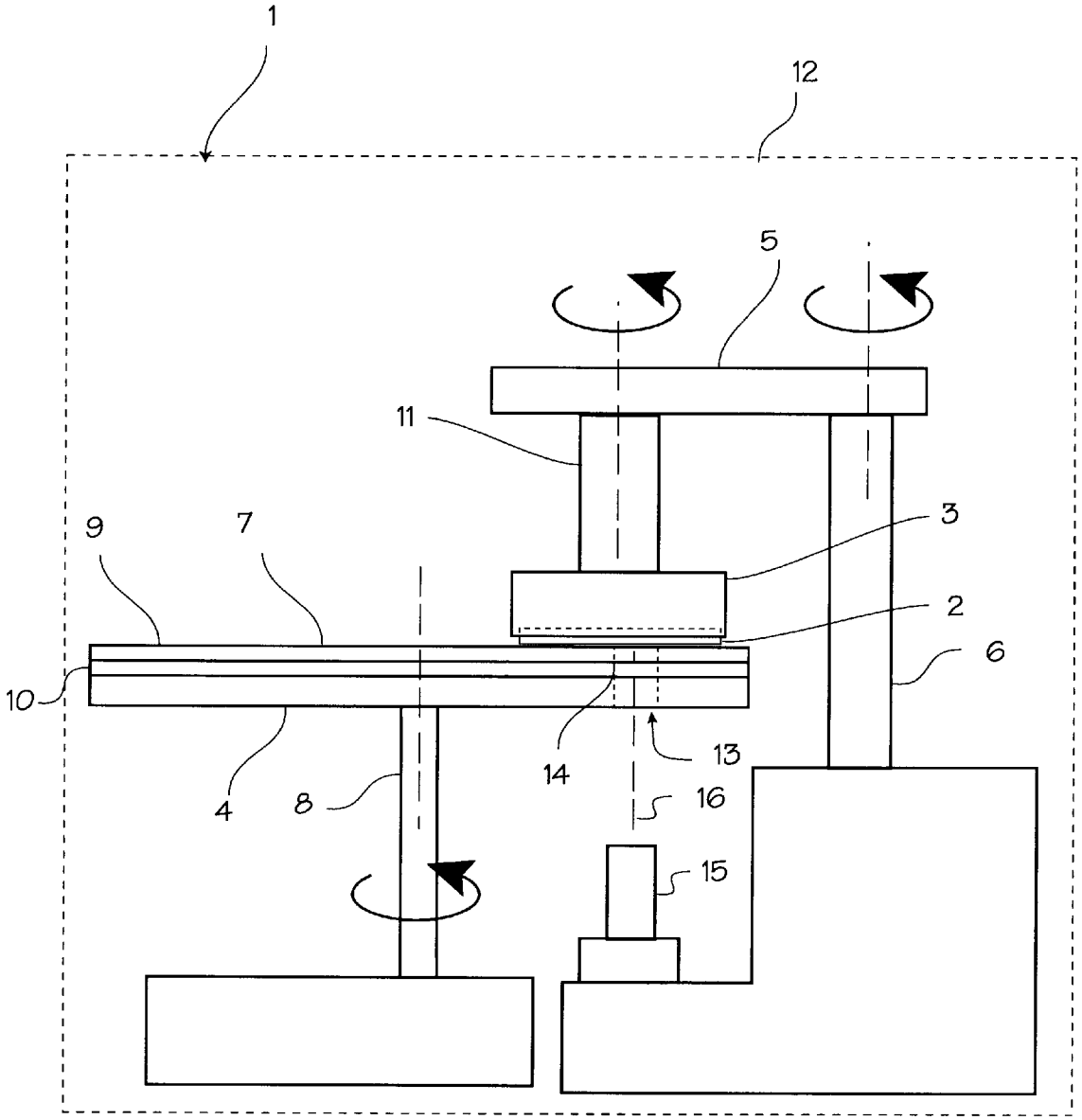
Fig. 1 (Prior Art)
FIG. 1 is an illustration of prior end point detection system in a chemical mechanical polishing chamber.

FIG. 1 shows a prior art chemical mechanical polishing apparatus 1 used to polish the semiconductor wafer 2 held by polishing head 3. The polishing head suspends the wafer above the polishing platen 4, while lightly forcing the wafer against the polishing pad. The polishing head is in turn held by the translating arm 5, which is supported and translated back and forth horizontally by the translation spindle 6. The polishing platen 4 holds, supports, and rotates the polishing pad 7. The polishing platen is rotated about its center axis by platen spindle 8 (referred to as the process table drive). The polishing pad 7 typically has a covering layer 9 secured to a backing layer 10 which adheres to the surface of the platen (the backing layer is not always used). The covering layer 9 is the polishing surface, and is comprised of an open cell foamed polyurethane (e.g. Rodel IC1000) or a sheet of polyurethane with a grooved surface (e.g. Rodel EX2000). The pad material is wetted with the chemical polishing slurry containing a slurry medium (water) an abrasive and chemicals. One typical chemical slurry includes KOH (Potassium Hydroxide) and fumed-silica particles. When slurry has been deposited on the polishing pad, the wafer is brought into contact with the polishing pad, and the platen is rotated about its central axis by spindle 8 while the polishing head is rotated about its central axis by polishing head spindle 11, and translated across (swept back and forth horizontally) the surface of the platen 4 via a translation arm 5. In this manner, the wafer is polished by the slurry loaded polishing pad. All the components are housed within the process chamber 12, since the agents used are caustic and corrosive, and the process is performed at elevated temperature. This system permits interferometry measurement through the platen aperture 13 and pad aperture 14 which overlies the platen aperture. These holes 13 and 14 are positioned on the platen/pad assembly such they are below the wafer 2 and polishing head 3 during a portion of the platen's rotation, regardless of the translational position of the head 3. A laser interferometer 15 is placed within the chamber is fixed below the platen 4 in a position enabling a laser beam 16 projected by the laser interferometer to pass through the platen aperture and pad aperture and strike the surface of the over-passing wafer 2 during a time when the apertures are passing under the wafer 2.

Figure 2:
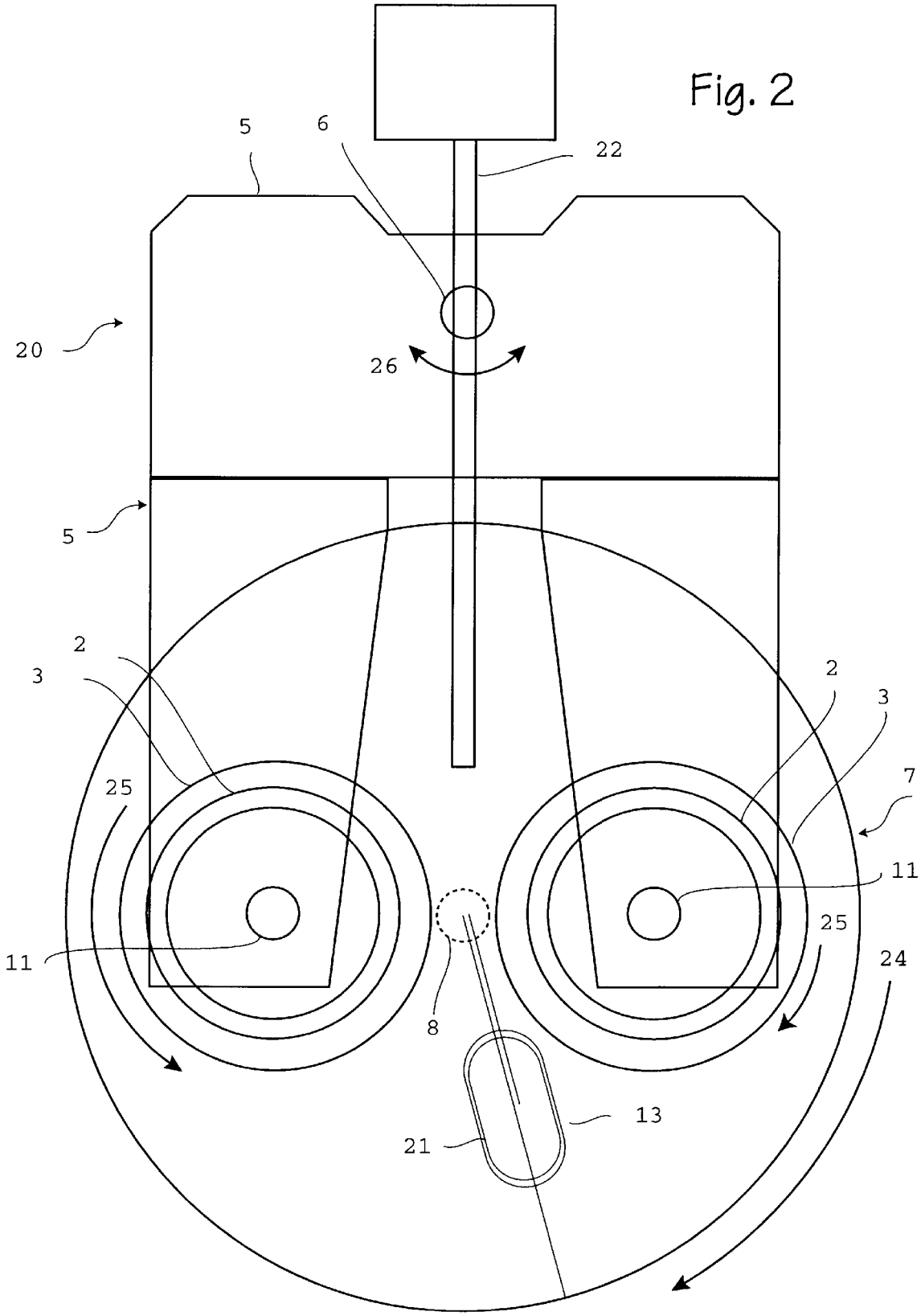
FIG. 2 is an overhead view of a chemical mechanical system with the optical endpoint window installed.
Figure 3:
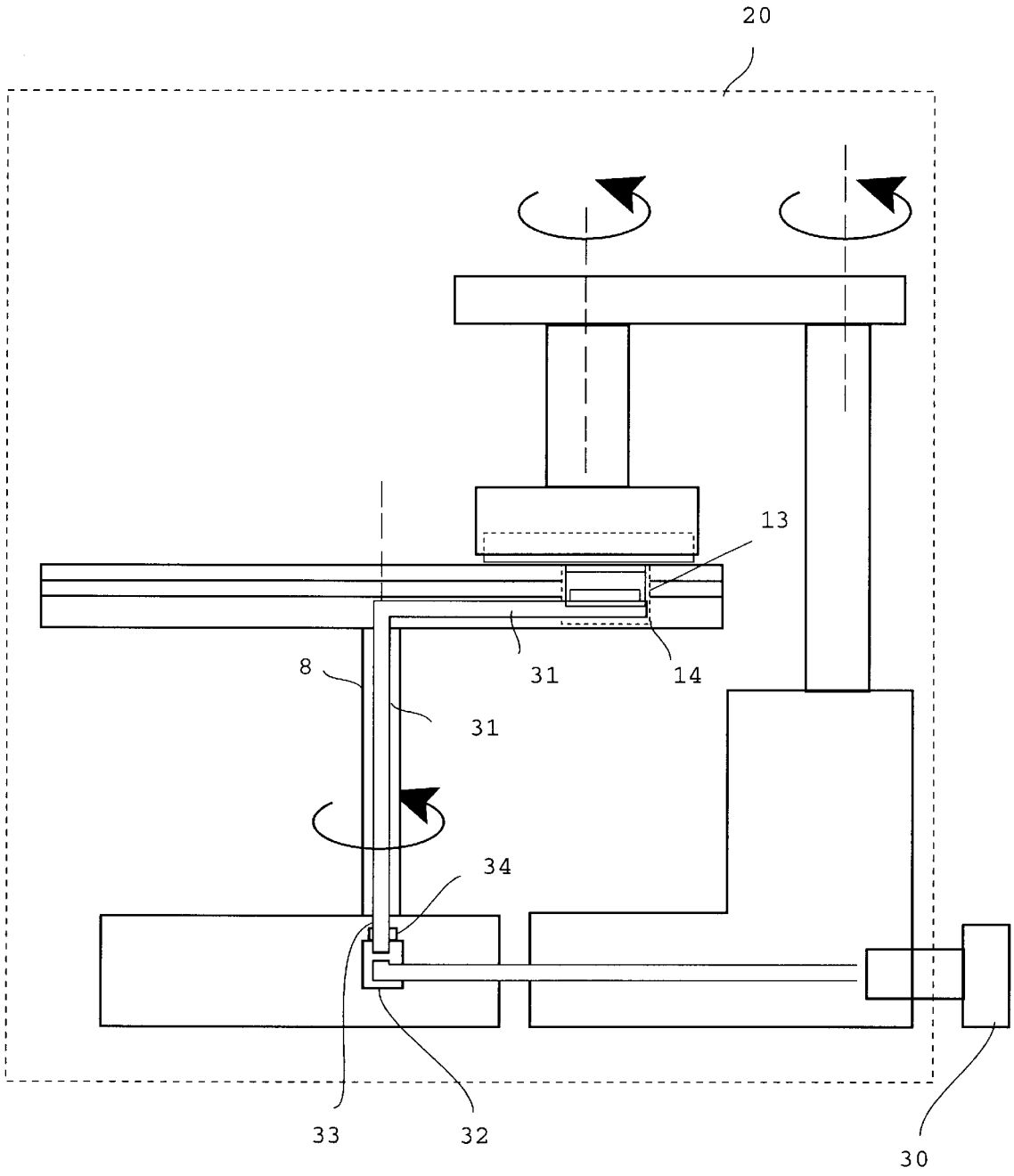
FIG. 3 is an side view of a chemical mechanical system with the optical endpoint window installed.

Our chemical mechanical polishing system is illustrated in FIGS. 2 and 3. FIG. 2 is an overhead view of a chemical mechanical system 20 with the optical endpoint window 21 installed. The wafer 2 (or other work piece requiring planarization or polishing) is held by the polishing head 3 and suspended over the polishing pad 7 from the translation arm 5. Other systems may use polishing heads that hold several wafers, and separate translation arms on opposite sides (left and right) of the polishing pad. The slurry used in the polishing process is injected onto the surface of the polishing pad through slurry injection tube 22. The optical endpoint window 21 located within polishing pad aperture 13 (and the underlying platen recess 23 (not visible)) and is centered on the polishing pad and underlying platen at a point which is radially midway between the center of the polishing pad and the outer edge of the polishing pad/platen assembly, so that it lies in the center of the wafer track (i.e., the center of the overall path of the wafer over the polishing pad). The window itself rotates with the polishing pad/platen assembly, which rotates on platen spindle 8 (shown in phantom) in the direction or arrow 24. The polishing heads rotate about their respective spindles 11 in the direction of arrows 25. The polishing heads themselves are translated back and forth over the surface of the polishing pad by the translating spindle 6, as indicated by arrow 26. Thus, the optical endpoint window 21 passes under the polishing heads while the polishing heads are both rotating and translating, swiping a complex path across the wafer surface on each rotation of the polishing pad/platen assembly.

FIG. 3 is a side view of a chemical mechanical system 20 with the optical endpoint window installed. The components correspond to the components shown in FIG. 2, including the wafer 2, polishing head 3, platen 4, translation arm 5, translation spindle 6, polishing pad 7 (with covering layer 9 and backing 10), process table drive spindle 8, polishing pad aperture 13, platen recess 14, optical endpoint window 21. The additional features shown in FIG. 3 permit the laser beam to be routed to the wafer surface regardless of the position of the platen recess and pad aperture in relation to the laser interferometer 30. A optical fiber bundle 31 is routed from the optical window at a point radially between the center of the platen and the outer edge of the platen, inwardly and radially toward the center of the platen, and downwardly from the platen to a rotary optical coupling 32. In the embodiment shown, the optical fiber bundle is routed up and down the process table drive spindle 8, and is vertically oriented, within the process table drive spindle. The fiber bundle turns 90° and runs horizontally and radially through the platen to reach the optical window. At the optical window housing, the fiber bundle turns upwardly to direct a laser beam transmitted through the fiber to the wafer surface through the window and any slurry between the window and the wafer. The bend radius of the turn at the platen axis and the optical window is limited as appropriate for the make of fibers chosen. Within the rotary optical coupling, the coupling end 33 of fiber bundle 31 rotates within rotary seal 34, and is optically coupled to the stationary fiber bundle 35 through appropriate beam splitting devices. The outgoing and reflected laser beams are transmitted from a laser source within laser interferometer. The laser interferometer is located outside the process chamber, since it need not be in line with any aperature in the platen.

Figure 4:
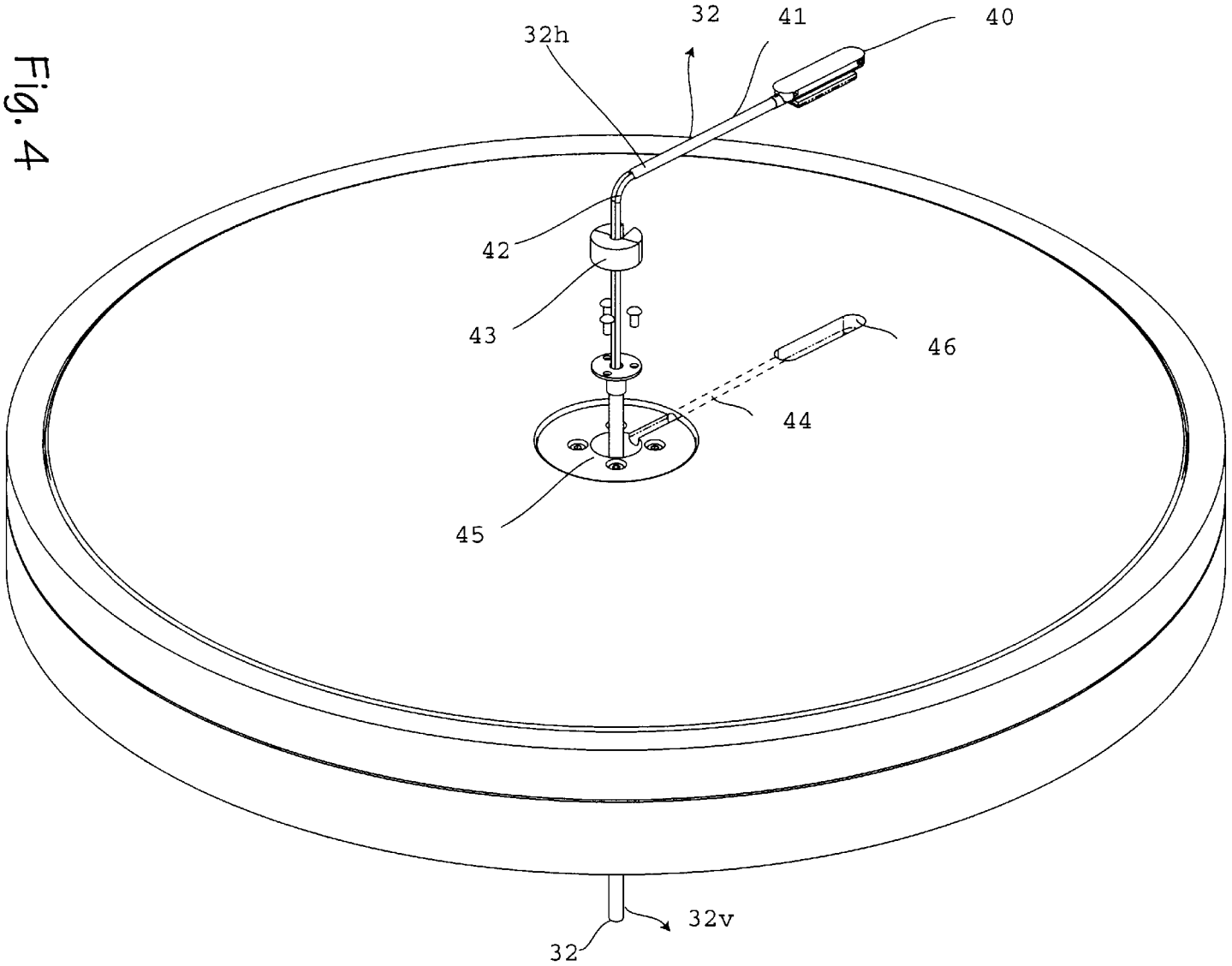
FIG. 4 is an elevation view of the optical endpoint window and fiber bundle assembly and polishing table.

FIG. 4 is a view of the optical endpoint window, fiber bundle assembly and polishing table. The fiber optic bundle 32 communicates with a horizontal segment 32*h* spanning from the optical viewport assembly 40 disposed on the radial extremity of the bundle cover tube 41 (which establishes the fiber bundle's horizontal and radial route through the platen), radially inwardly through the bundle cover tube 41 and through downward bend 42, where the same bundle runs vertically downward (segment 32*v*) through collar 43 to terminate in the rotary bundle coupling end 33 which rotates freely within the rotary seal shown in FIG. 3, The bundle cover tube 41 will reside in the fiber bundle channel 44 in the platen, which communicates from the center aperture 45 in the platen to the viewport assembly recess 46 located radially about halfway between the center of the platen and the outer edge of the polishing pad.

Figure 5:
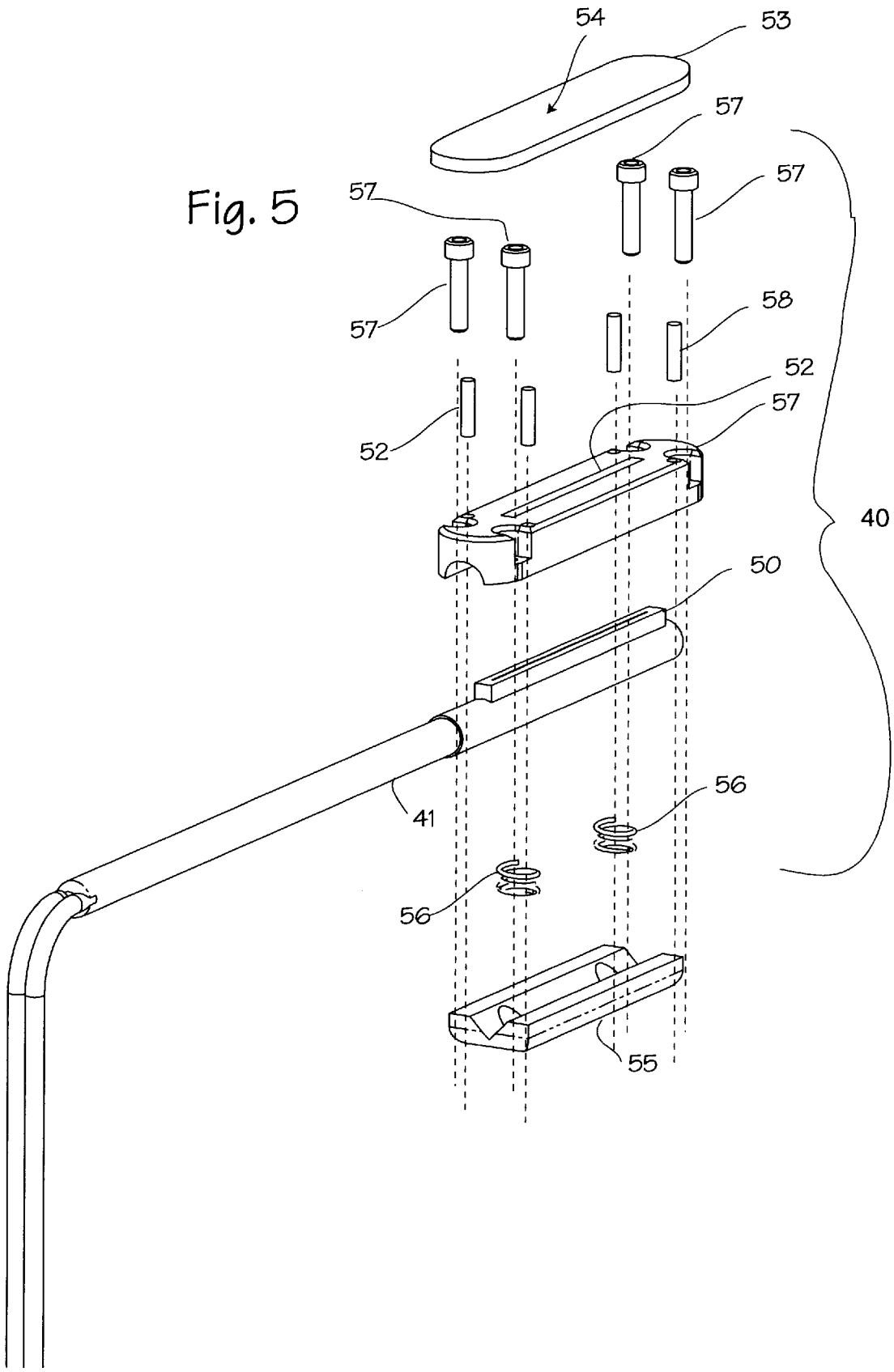
FIG. 5 is an close up elevation view of the optical endpoint window.

Referring to FIG. 5, the optical viewport assembly 40 is shown in greater detail. A fiber output array 50 holds the optical fibers of the bundle within the channel, with the light emitting/receiving ends of each fiber facing upward into endpoint window (and hence into the face of an overlying wafer). The endpoint window is placed over the upper face of an endpoint window casing or array bracket 51, covering the aperture 52. The aperture 52 fits closely over fiber array 50. The window casing 51 is secured to the bottom of the recess 46, aligned over the cover tube 41 and array channel fiber array 50. The window pane 53 is the transparent barrier interposed between the fiber optic array and the process chamber environment (and, as described below, its upper surface 54 is maintained coplanar with the upper surface of the polishing pad. The window pane is made of a transparent material such as polyurethane, or clear plastics such a Clariflex™ and polyIR5™. The thickness of this window pane may be varied for use with different makes of polishing pads to ease the amount of adjustment necessary to make the upper surface of the window flush with the upper surface of the polishing pad. Centering support member 55 rests in a recess in the platen, with support springs 56 interposed between the support member and the cover tube 41 (or resting on the bottom of the recess and extending through holes in the support member). The centering support member has a V-shaped channel running through its upper surface, providing a resting place for the radial end of the fiber bundle cover tube 41 which assure that it passes through the center of the window assembly. The centering support member is made of a low durometer (about 30–50 Shore A) polyurethane or similar material, so that it functions to cushion and support the fiber array 50. The entire assembly is inserted into a recess 46 (FIG. 4) within the polishing platen. The window casing 51 is located relative to the platen with height adjusting screws 57, which may be adjusted to raise and lower the window casing, and thus the window pane, to be perfectly flush with the polishing pad upper surface. The window casing 51 is secured in place relative to the platen with a fastener such as the locking screws 58, which penetrate the window casing and enter receiving bores in the platen. Adjustment of the set screws and tightening of the locking screws ensure perfect alignment of the window casing so that the upper surface of the window casing it parallel to the platen surface, and hence the window upper surface of the window pane will be flat relative to the upper surface of the polishing pad. Hence the upper surface of the window pane is maintained flush (parallel and coplanar with) the upper surface of the polishing pad. For grooved pads, the window may be adjusted to match the top of the grooves, and the pad itself may be grooved to match the grooves of the pad.

Figure 6:
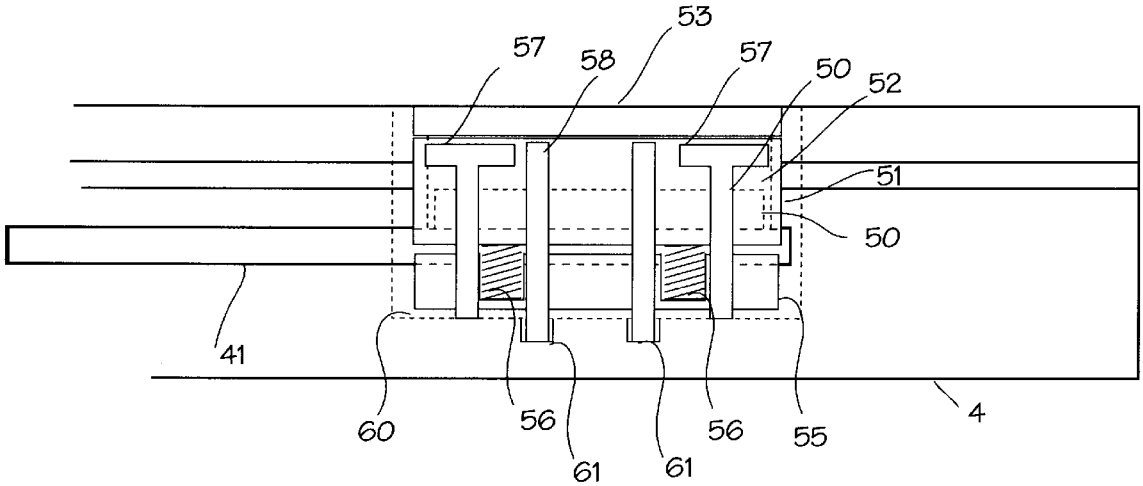
FIG. 6 is a cross section of the optical endpoint window assembly in place within the platen.

The side view cross section of FIG. 6 shows a close up view of the window assembly within the platen 4 and extending through the polishing pad. The bundle cover tube 41 extends through the viewport assembly and rests on the support member 55 and the support springs 56. The fiber array 50 extends upwardly into the aperture 52 in the window casing. The window casing 51 is supported above the fiber optic array by the set screws 57 engaging the bottom surface 59 of the platen recess. The vertical position of the window casing and window is maintained by the locking screws 58 which enter threaded receiving bores 60 in the platen recess. The window pane 53 is secured to the upper surface of the window casing with adhesives, tiny screws or other suitable means.

In use, the viewport assembly is placed in the recess, and adjusted in height so that the window pane upper surface is flush with the upper surface of the pad. The platen is rotated, and the viewport and viewport assembly rotate with the table, orbiting around the platen center. The viewport passes under the wafers repeatedly during the planarization process, allowing numerous measurements of wafer layer thickness.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A system for planarizing the surface of a workpiece, wherein said system comprises a planarizing device including process chamber which houses a rotating platen with a polishing pad disposed on the platen surface, a polishing head for holding the workpiece over the polishing pad, a platen drive spindle which rotates the platen about its center, said device further comprising:

a recess in the platen located radially displaced from the center of the platen, said recess having a bottom surface within the platen;

an aperture in the polishing pad, said aperture overlying the recess in the platen an optical viewport assembly housed within the recess in the platen, said optical viewport assembly comprising a support member, a window casing, a window pane, and an optical fiber array, said support member resting on the bottom surface of the recess and supporting the optical fiber array, said window casing is disposed over the optical fiber array and is provided with an aperture disposed over the fiber array, said window casing being supported relative to the platen with at least one set screw which can be adjusted to raise and lower the window casing relative to the platen, at least one fastener for locking the window casing in place relative to the platen; and an optical fiber bundle communicating from the optical fiber array, radially inward toward the center of the platen, and then through the platen drive spool to an optical coupling.

2. A system for planarizing the surface of a workpiece, wherein said system comprises a planarizing device including process chamber which houses a rotating platen with a polishing pad disposed on the platen surface, a polishing head for holding the workpiece over the surface of the polishing pad, a platen drive spindle which rotates the platen about its center, said device further comprising:

a recess in the platen located radially displaced from the center of the platen, said recess having a bottom surface within the platen;

an aperture in the polishing pad, said aperture overlying the recess in the platen;

an optical viewport assembly housed within the recess in the platen, said optical viewport assembly comprising a support member, a window casing, a window pane, and an optical fiber array, said support member resting on the bottom surface of the recess and supporting the optical fiber array, said window casing is disposed over the optical fiber array and is provided with an aperture disposed over the fiber array, said window casing being supported relative to the platen with at least one set screw which can be adjusted to raise and lower the window casing relative to the platen, at least one fastener for locking the window casing in place relative to the platen, said optical viewport extending from the platen into the aperture of the polishing pad, and said window pane being flush with the surface of the polishing pad;

an optical fiber bundle communicating from the optical fiber array, radially inward toward the center of the platen, and then through the platen drive spool to a rotary optical coupling;

said rotary optical coupling communicating with a laser interferometer capable of transmitting and receiving laser beams to the rotary optical coupling, said laser interferometer being located outside the process chamber.

* * * * *